US006849829B1

(12) United States Patent
Otterbach

(10) Patent No.: US 6,849,829 B1
(45) Date of Patent: Feb. 1, 2005

(54) GLOW PLUG WITH FRUSTOCONICAL CERAMIC HEATING ELEMENT

(75) Inventor: Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/149,484

(22) PCT Filed: Oct. 27, 2000

(86) PCT No.: PCT/DE00/03800

§ 371 (c)(1),
(2), (4) Date: Oct. 25, 2002

(87) PCT Pub. No.: WO01/42714

PCT Pub. Date: Jun. 14, 2001

(30) Foreign Application Priority Data

Dec. 11, 1999 (DE) ..... 199 59 768

(51) Int. Cl.[7] ..... F23Q 7/00
(52) U.S. Cl. ..... 219/270; 123/145 A
(58) Field of Search ..... 219/270, 544, 219/541, 552, 553; 123/145 A, 145 R; 361/264–266; 338/217

(56) References Cited

U.S. PATENT DOCUMENTS 4,475,029 A * 10/1984 Yoshida et al. ..... 219/270
4,653,443 A * 3/1987 Fukazawa et al. ..... 123/145 A
4,742,209 A * 5/1988 Minegishi et al. ..... 219/270
4,914,274 A * 4/1990 Hatanaka et al. ..... 219/270
4,914,751 A * 4/1990 Masaka et al. ..... 219/270
5,304,778 A * 4/1994 Dasgupta et al. ..... 219/270
5,993,722 A * 11/1999 Radmacher ..... 264/442
6,054,680 A * 4/2000 Locher et al. ..... 219/270
6,184,497 B1 * 2/2001 Leigh ..... 219/270
6,437,492 B1 * 8/2002 Geissinger et al. ..... 313/118
6,727,473 B2 * 4/2004 Taniguchi et al. ..... 219/270
2002/0153365 A1 * 10/2002 Taniguchi et al. ..... 219/270

FOREIGN PATENT DOCUMENTS

| | | |
|---|---|---|
| DE | 3712414 | * 10/1987 |
| EP | 0 438 097 | 7/1991 |
| JP | 58-62427 | * 4/1983 |
| JP | 61 225 517 | 10/1986 |
| JP | 63-297924 | * 12/1988 |

* cited by examiner

*Primary Examiner*—John A. Jeffery
(74) *Attorney, Agent, or Firm*—Kenyon & Kenyon

(57) ABSTRACT

A sheathed-element glow plug for starting a thermal combustion process, in particular for starting a self-igniting combustion engine, having a housing, which may be sealingly mounted in a wall of a combustion chamber and accommodates a ceramic heating element that extends into the combustion chamber. The heating element includes a heating conductor, which is connectible to a voltage source and has an electrical resistance, and the electrically conductive cross-section of the heating conductor is smaller in the region of a heating-element tip than an electrically conductive cross-section in the region of a heating-element body. It is proposed that the heating-element tip include at least one frustoconical segment.

12 Claims, 2 Drawing Sheets

GLOW PLUG WITH FRUSTOCONICAL CERAMIC HEATING ELEMENT

FIELD OF THE INVENTION

The present invention relates to a sheathed-element glow plug for starting a thermal combustion process, in particular for starting a self-igniting combustion engine.

BACKGROUND INFORMATION

Sheathed-element glow plugs of this type are well-known. These are used for starting self-igniting combustion engines (diesel engines). It is known that the self-igniting combustion process requires initial ignition. To this end, sheathed-element glow plugs are used, which are sealingly mounted in the wall of a combustion chamber (in the case of a combustion engine, a cylinder chamber) in such manner, that a heating element extends into the combustion chamber. In this connection, the heating element is in contact with a fuel-air mixture to be ignited.

It is known that one can use ceramic heating elements, whose glowing segment is made of a ceramic, electrically conductive material. These are distinguished by a high rigidity and a high resistance to the atmosphere prevailing in the combustion chamber. In addition, ceramic heating elements are resistant to high temperatures.

In order to start the self-igniting combustion engine, the heating element is connected to a voltage source (normally an automotive battery in motor vehicles). A current, which causes the glowing segment of the heating element to heat up, flows as a function of the electrical resistance of the heating element.

In order to rapidly heat the tip of the heating element, it is known that, in the region of the tip of the heating element, one may locally provide a ceramic material that has a higher specific electrical resistance than the rest of the heating-element body. This concentrates the electrical resistance of the heating element in the heating-element tip, so that it locally heats up in a more rapid and intense manner. In this case, it is disadvantageous that such heating elements, which have different materials exhibiting different specific electrical resistances, are difficult and costly to manufacture.

German Published Patent Application No. 195 06 950 describes a sheathed-element glow plug, in which the electrically conductive cross-section is reduced in the region of a heating-element tip. This reduction in the electrically conductive cross-section causes the heating element to heat up more intensely here than in the rest of it. The electrically conductive cross-section is reduced by providing the sheathed-element glow plug with bore holes, which are subsequently filled up with an electrically insulating material. In this connection, it is disadvantageous that such a reduction in the cross-section may only be attained in a costly manner, using additional manufacturing-method steps. In particular, when electrically insulating materials are introduced in the region of the sheathed-element glow plug experiencing the most heating, the different thermal expansion coefficients of the materials utilized can cause mechanical stresses to build up, which may result in damage to or the destruction of the sheathed-element glow plug.

SUMMARY OF THE INVENTION

In contrast, the sheathed-element glow plug of the present invention allows the electrical resistance in the region of the heating-element tip to be increased in a simple manner. Because an electrically conductive cross-section of the glowing part of the heating element is smaller in the region of the heating-element tip than in the region of a heating-element body, and the heating-element tip includes a section that runs frustoconically with respect to a longitudinal axis of the sheathed-element glow plug, the same material having the same specific electrical resistance may be used in the heating-element tip as in the entire heating-element body. Because of the known dependence of the electrical resistance on the cross-section of a conductor through which current is flowing, a reduction in the electrically conductive cross-section in the region of the heating-element tip results in a local increase of the resistance. Therefore, by specially machining the sheathed-element glow plug in the region of the heating-element tip, an electrical resistance may be set, which is optimal with regard to the necessary glow temperature, in conjunction with a very short heating time. Since the electrical resistance is now a function of the machining, such sheathed-element glow plugs may be manufactured in a simple manner, using appropriate form tools. Since the sheathed-element glow plug is already obtained by machining, the cost of adjusting the reduced, electrically conductive cross-section is negligible.

Such a frustoconical section allows the electrically conductive cross-section of the glowing segment to be reduced in the region of the heating-element tip, in an exactly reproducible manner. Furthermore, a frustoconical section may be formed in a reproducible manner suitable for large-scale production, using simple form tools.

A preferred refinement of the present invention provides for a surface of the heating-element tip, which runs perpendicularly to the longitudinal axis of the sheathed-element glow plug, changing into a frustoconical section via a bevel. The introduction of the bevel reduces the cross-section and therefore increases the resistance of the tip. This frustum may be machined to reduce its height, and a specific, electrically conductive cross-section of the glowing section may therefore be set at the heating-element tip. In particular, this allows the electrical resistance of the entire heating element to be set in an exact manner, by adding onto and/or machining the frustum to increase and/or decrease its height, while measuring the resistance. By this means, the electrical with resistance may be adjusted to desired parameters, in particular a temperature to be attained in the region of the heating-element tip. Such process steps may be automated in a manner suitable for large-scale production.

DETAILED DESCRIPTION

Figure 1:
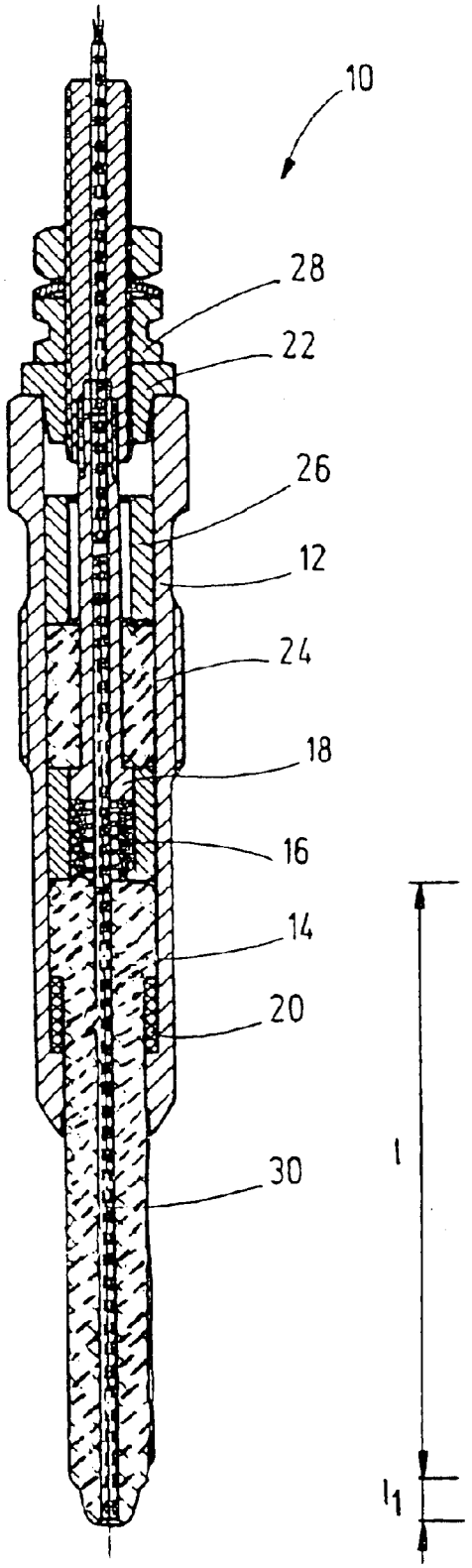
FIG. 1 shows a sectional view of a sheathed-element glow plug.

FIG. 1 shows a sheathed-element glow plug 10, which may be used to start a self-igniting combustion engine. Sheathed-element glow plug 10 includes a plug housing 12, which is essentially formed in the shape of a hollow cylinder. Plug housing 12 accommodates a heating element 14. Plug housing 12 may be sealingly mounted in a wall of a cylinder housing, so that heating element 14 extends into the combustion chamber. Heating element 14 is connected to a contact stud 18 in an electrically conductive manner, via a contact spring 16. Contact stud 18 may be connected to a voltage source, e.g. to the automotive battery in a motor vehicle, in a manner not shown in further detail, so that a voltage U+ may be applied to heating element 14, via contact stud 18 and contact spring 16. The heating element 14 itself includes a layer (glowing segment) made of a ceramic, electrically conductive material, which is embedded in outer layers made of an electrically nonconductive ceramic. By this means, a U-shaped conductor loop is formed from the electrically conductive ceramic, which constitutes a heating conductor. Sheathed-element glow plug 10 includes further components, of which seals 20 and 22, a ceramic sleeve 24, a metal ring 26, and a tension element 28 are marked. Seal 20 may simultaneously be designed to form an electrical connection to plug housing 12, by which grounded connection U is in turn produced. The design and function of such sheathed-element glow plugs 10 are generally known, so that this is not described in greater detail within the framework of the present description.

Heating element 14 also has a core 30 made of an electrically insulating material.

Figure 1A:
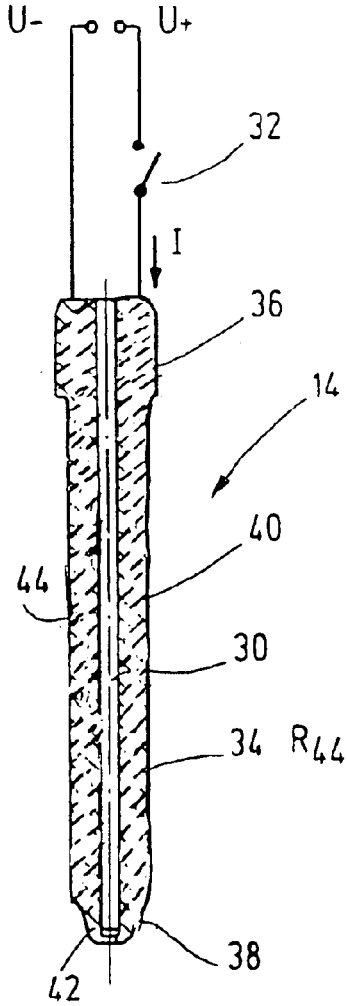

Heating element 14 is shown separately in FIG. 1*a*, it being schematically indicated that voltage U may be applied to heating element 14 by switching element 32. FIG. 1*a* shows a longitudinal cross-section of the electrically conductive ceramic layer. When switching element 32 is closed, current I consequently flows through heating element 14. The layered design of heating element 14 causes the electrically conductive ceramic to form a U-shaped element, which wraps around core 30 in the direction of the flow of current I. Heating element 14 includes a heating-element body 34 of length l and is essentially cylindrical. Inside plug housing 12, heating-element body 34 forms an annular ring 36 that is supported at plug housing 12 by seal 20. On the end opposite annular ring 16, heating-element body 34 changes into a heating-element tip 38, which has a length $l_1$.

Figure 1B:
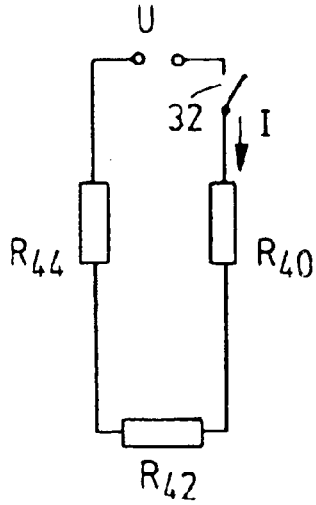

Such a design of heating element 14 yields a total of three electrically conductive segments of heating element 14, namely a first segment 40 from annular ring 36 to heating-element tip 38, a second segment 42 inside heating-element tip 42, and a third segment 44 from heating-element tip 42 back to annular ring 36. The electrically conductive ceramic material of heating element 14 has a known specific electrical resistance, so that heating element 14 may be transformed into the equivalent circuit diagram shown in FIG. 1*b*. This yields a series circuit of electrical resistors $R_{40}$ of segment 40, $R_{42}$ of segment 42, and $R_{44}$ of segment 44. Therefore, total resistance R for heating element 14 results from the equation $R=R_{40}+R_{42}+R_{44}$.

Given a known specific electrical resistance of the material of heating element 14, it is necessary for the individual resistances to have a certain relationship to each other, in order to reach the intended glowing temperature in the region of heating-element tip 38 within a very short heating time, e.g. 950° C. within a maximum of 2 s, during normal use of sheathed-type glow plug 10. In this case, the ratio of resistance $R_{42}$ to total resistance R must be much greater than the ratio of the sum of resistances $R_{40}+R_{44}$ to total resistance R. In addition, it is necessary for resistance $R_{30}$ of core 30 to be much greater than resistance R of heating element 14.

Because resistance $R_{42}$, is much greater than the sum of resistances $R_{40}+R_{44}$, the magnitude of glow current I is obtained from constant voltage U and resistance R. When voltage U and current I are constant, the voltage drop across partial resistors $R_{40}$, $RP_2$, and $R_{44}$ is largest where the electrical resistance is greatest. If this is the case at resistor $R_{42}$, then the voltage drop is greatest there. By specifying the ratio of the magnitude of resistance $R_{12}$, on one hand, to the sum of resistances $R_{40}$ and $R_{44}$, on the other hand, the largest voltage drop may be concentrated at resistor $R_{42}$ when its resistance is designed to be appropriately large. Since the heating power generated is, in turn, directly dependent on the constant current and the voltage drop, the greatest heating power is obtained in the region of heating-element tip 38.

It is known that resistance R is a function of both length l and cross-sectional area A of an electrical conductor, as well as its specific electrical resistance. Given a constant length l and the same specific electrical resistance, resistance R increases as cross-sectional area A decreases. The different exemplary embodiment shown in FIGS. 2 through 4 reflect the use of this relationship to optimize the design of heating-element tip 38. The optimized geometry is used to achieve the object of concentrating a high electrical resistance $R_{42}$ in the region of heating-element tip 38, given the same specific electrical resistance values for the electrically conductive ceramic material used for heating-element body 34 and heating-element tip 38. Each of FIGS. 2 through 4 represents an enlarged schematic view of a heating-element tip 38.

Figure 2:
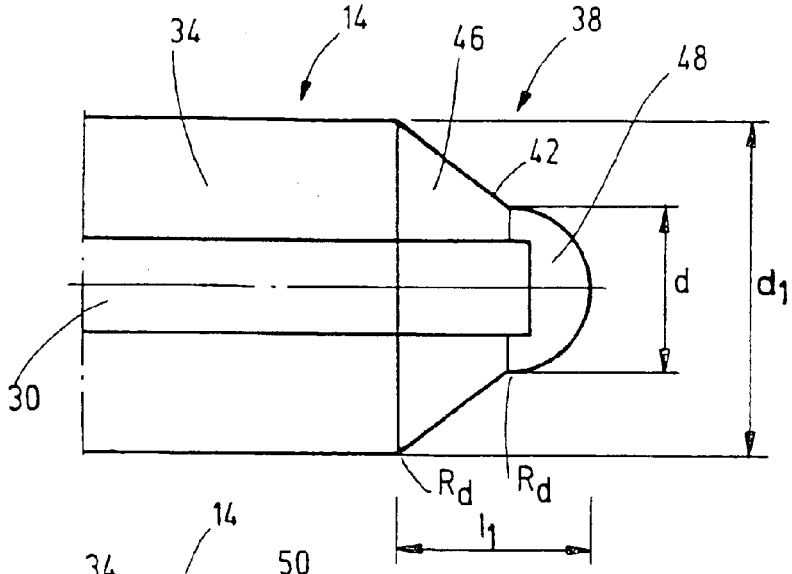
FIG. 2 is a first schematic sectional view of a first heating-element tip.

FIG. 2 shows that heating-element tip 38 is made of a first frustoconical segment 46, to which a hemispherical segment 48 is contiguous. Hemispherical segment 48 has a diameter d, which is less than diameter $d_1$ of heating-element body 34. Diameter $d_1$ is adjusted to diameter d, via frustoconical segment 46. This results in a decrease in the cross-sectional area, i.e. as viewed in a plane perpendicular to the plane of the paper, along the length $l_1$ of heating-element tip 38, from heating-element body 34 to hemispherical segment 48. Therefore, the smallest cross-sectional area A of electrically conductive segment 42 of heating-element tip 38 may be determined by the selection of diameter d of hemispherical segment 48. This occurs in the transition region between frustoconical segment 46 and hemispherical segment 48. When voltage U is known and the specific electrical resistance of the utilized material is known, resistance $R_{42}$ of heating-element tip 38 can therefore be optimized by the selection of diameter d of hemispherical segment 48 and the selection of length $l_1$.

Figure 3:
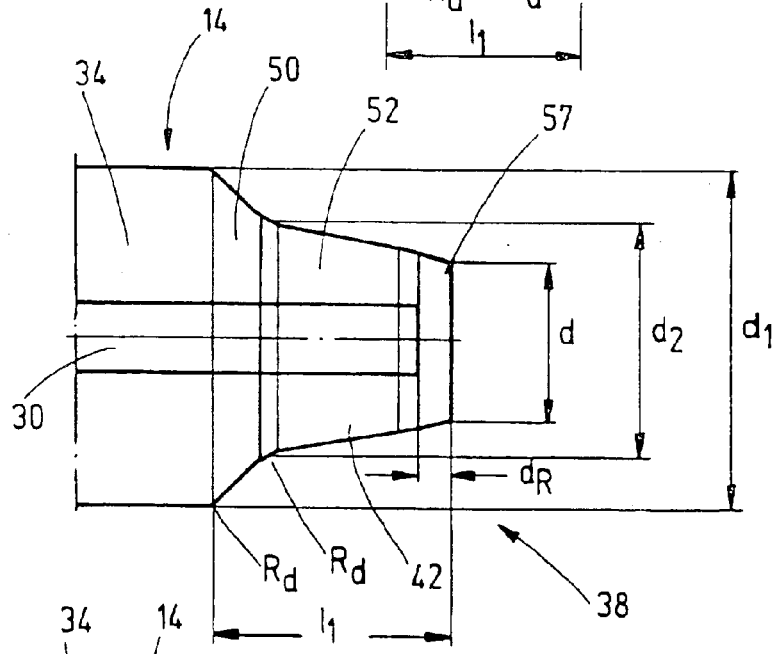
FIG. 3 is a second schematic sectional view of a second heating-element tip.
Figure 4:
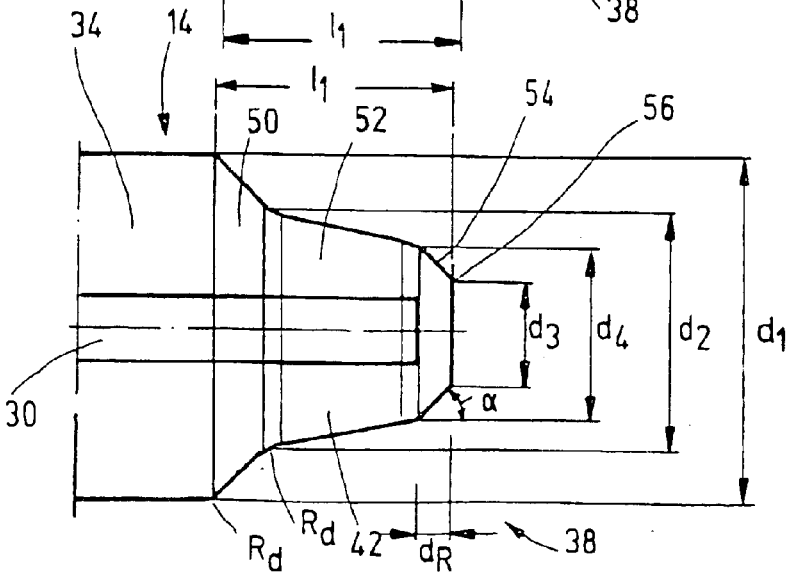
FIG. 4 is a third schematic sectional view of a third heating-element tip.

In the exemplary embodiment shown in FIG. 3, heating-element body 34 changes into a second frustoconical segment 52, via a first frustoconical segment 50. The entrance diameter of frustoconical segment 50 corresponds to diameter $d_1$ of heating-element body 34. Exit diameter $d_2$ of frustoconical segment 50 corresponds to the entrance diameter of frustoconical segment 52, which narrows down to diameter d. The selection of the ratios of diameters d and $d_2$ to diameter $d_1$ allows cross-section A of line segment 42 to be adjusted. The smaller the diameters d and $d_2$, the smaller the cross-sectional area A of circuit segment 42, and as a result, the selection of diameters d and $d_2$ and length $l_1$ allows resistance $R_{42}$ of heating-element tip 38 to be optimized.

Reducing layer thickness $d_R$ of segment 57 allows a subsequent correction of the resistance within certain limits.

FIG. 4 shows a particularly preferred embodiment variant, in which frustoconical segment 52 is provided with a bevel 54. This creates an additional frustoconical segment 56 at heating-element tip 38, the additional frustoconical segment changing over from entrance diameter $d_4$ to diameter $d_3$. The ratio of diameter $d_3$ to $d_4$ may be adjusted in accordance with an angle $\alpha$ of bevel 54 to a longitudinal axis of heating element 14. The larger this angle $\alpha$, the smaller the cross-sectional area A of circuit segment 42 in the region of frustoconical segment 56. Reducing a layer thickness $d_R$ of segment 56 allows a subsequent correction of the resistance within certain limits. According to the known relationships, this results in an increase of resistance $R_{42}$.

In light of the exemplary embodiments, it becomes immediately apparent that simple geometric designs allow a cross-section A of circuit segment 42, and therefore an increase in resistance $R_{42}$, to be achieved. By this means, very short heating times may be achieved at sheathed-element glow plug 38. The maximum glowing temperature of heating element 14, in particular at heating-element tip 38, may be adjusted in accordance with the specific electrical resistance of the utilized material and the temperature coefficient of the material, by optimizing cross-sectional area A in conjunction with length l1, i.e. by optimizing resistance $R_{42}$. If a ceramic having a positive temperature coefficient, i.e. resistance R increases with increasing temperature, is used as the material for heating element 34, then a self-regulating heating-element temperature may be achieved by reducing glow current I in response to increasing resistance R.

The proposed geometries of heating elements 14 may be manufactured in a simple manner. Heating elements 14 are formed from a "green" ceramic material in a known manner, and are subsequently sintered. It is also conceivable to manufacture the ceramic heating elements, using injection-molding technology. In the case of sintered heating elements, frustoconical segments 46, 50, and 52, and hemispherical segment 48, may be produced by appropriate form tools during the machining. In particular, in the exemplary embodiment shown in FIG. 4, subsequently reducing layer thickness $d_R$ allows resistance $R_{42}$ of heating-element tip 38 to be adjusted in a selected manner. Thus, manufacturing tolerances of heating element 14, which may occur as a result of core 30 being offset from the longitudinal axis of heating element 14, or in response to a deviation in the specific electrical resistance, may be compensated for. This operation may be automated during the manufacture of the heating element. The resistance is measured while machine-grinding is simultaneously taking place. By this means, layer thickness $d_R$ is reduced so that the resistance increases. The machine-grinding is stopped upon reaching the setpoint resistance.

The manufacturing may necessitate the individual segments of heating element 14 merging via radii $R_d$. However, these radii $R_d$ have only a negligible affect on the cross-sectional area A to be adjusted, and therefore on the resistance $R_{42}$ of heating-element tip 38 to be adjusted.

Apart from starting a self-igniting combustion engine, the sheathed-element glow plug of the present invention may also be used, for example, to start a thermal combustion process, e.g. in gas heaters.

It is also within the spirit of the present invention when, in addition to the described options for controlling the resistance, heating-element tip 38 is made of a material having a different specific electrical resistance than the remaining regions of heating element 14.

What claimed is:

1. A sheathed-element glow plug for starting a thermal combustion process, comprising:

a housing capable of being sealingly mounted in a wall of a combustion chamber; and a ceramic heating element that is accommodated in the housing and that extends into the combustion chamber, wherein:

the ceramic heating element includes a heating conductor that is connectible to a voltage source and has an electrical resistance, and an electrically conductive cross-section of the heating conductor is smaller in a region of a tip of the ceramic heating element than in an electrically conductive cross-section in a region of a body of the ceramic heating element, and the tip of the ceramic heating element has a frustoconical shape, wherein the end of the frustoconical-shaped tip includes a hemispherical segment, a first diameter of the tip of the ceramic heating element being smaller than a second diameter of the body of the ceramic heating element.

2. The sheathed-element glow plug as recited in claim 1, wherein the sheathed-element glow plug is for starting a self-igniting thermal combustion process.

3. The sheathed-element glow plug as recited in claim 1, wherein:

the electrically conductive cross-section is adjustable by defining a ratio of the first diameter to the second diameter, in conjunction with a length of the frustoconical tip.

4. The sheathed-element glow plug as recited in claim 1, wherein:

the electrically conductive cross-section is adjustable by selecting a layer thickness of the frustoconical tip.

5. The sheathed-element glow plug as recited in claim 1, wherein:

in a region of the tip of the ceramic heating element, the ceramic heating element is made of a material having a different specific electrical resistance than in a region of the body of the ceramic heating element body.

6. A sheathed-element glow plug for starting a thermal combustion process, comprising:

a housing capable of being sealingly mounted in a wall of a combustion chamber; and a ceramic heating element that is accommodated in the housing and that extends into the combustion chamber, wherein:

the ceramic heating element includes a heating conductor that is connectible to a voltage source and has an electrical resistance, and an electrically conductive cross-section of the heating conductor is smaller in a region of a tip of the ceramic heating element than in an electrically conductive cross-section in a region of a body of the ceramic heating element, and the tip of the ceramic heating element is frustoconical; and wherein the frustoconical tip includes a first frustoconical segment and a second frustoconical segment, an exit diameter of the first frustoconical segment corresponding to an entrance diameter of the second frustoconical segment.

7. The sheathed-element glow plug as recited in claim 6, wherein:

the frustoconical tip includes a bevel.

8. The sheathed-element glow plug as recited in claim 7, wherein:

the electrically conductive cross-section is adjustable by selecting an angle of the bevel to a longitudinal axis of the ceramic heating element.

9. The sheathed-element glow plug as recited in claim 6, wherein the sheathed-element glow plug is for starting a self-igniting thermal combustion process.

10. The sheathed-element glow plug as recited in claim 6, wherein:

the tip of the ceramic heating element includes a hemispherical segment, and a first diameter of the tip of the ceramic heating element is smaller than a second diameter of the body of the ceramic heating element.

11. The sheathed-element glow plug as recited in claim 6, wherein:

the electrically conductive cross-section is adjustable by selecting a layer thickness of the frustoconical tip.

12. The sheathed-element glow plug as recited in claim 6, wherein:

in a region of the tip of the ceramic heating element, the ceramic heating element is made of a material having a different specific electrical resistance the ceramic heating element.

* * * * *

UNITED STATES PATENT AND TRADEMARK OFFICE

CERTIFICATE OF CORRECTION

PATENT NO. : 6,849,829 B1
APPLICATION NO. : 10/149484
DATED : February 1, 2005
INVENTOR(S) : Wolfgang Otterbach It is certified that error appears in the above-identified patent and that said Letters Patent is hereby corrected as shown below:

Column 6,
Lines 64-65, change "electrical resistance the ceramic heating element" to -- electrical resistance than in a region of the body of the ceramic heating element. --.

Signed and Sealed this

Eleventh Day of July, 2006

JON W. DUDAS
*Director of the United States Patent and Trademark Office*